US007717418B2

(12) United States Patent
Kern et al.

(10) Patent No.: US 7,717,418 B2
(45) Date of Patent: May 18, 2010

(54) ENVELOPE CONVEYING AND POSITIONING APPARATUS AND RELATED METHODS

(75) Inventors: Peter Kern, Guernsey (GB); Reinhard Buri, Donaueschingen/Pfohren (DE)

(73) Assignee: Kern International, Inc., Grove City, OH (US)

( * ) Notice: Subject to any disclaimer, the term of this patent is extended or adjusted under 35 U.S.C. 154(b) by 0 days.

(21) Appl. No.: 12/231,755

(22) Filed: Sep. 5, 2008

(65) Prior Publication Data

US 2010/0059920 A1 Mar. 11, 2010

(51) Int. Cl.
*B65H 1/02* (2006.01)

(52) U.S. Cl. ..... 271/146; 271/2; 271/152; 271/153

(58) Field of Classification Search ..... 271/2, 271/31.1, 149, 150, 152, 153, 154, 155, 3.11
See application file for complete search history.

(56) References Cited

U.S. PATENT DOCUMENTS

| | | | | |
|---|---|---|---|---|
| 24,459 | A | 6/1859 | Hall | |
| 2,915,863 | A | 12/1959 | Kummer | |
| 3,253,384 | A | 5/1966 | Huck et al. | |
| 3,568,401 | A | 3/1971 | Bonsch | |
| 3,753,836 | A | 8/1973 | Buckholz | |
| 3,872,649 | A | 3/1975 | Wimmer | |
| 4,132,402 | A | 1/1979 | Morrison et al. | |
| 4,360,356 | A | 11/1982 | Hall | |
| 4,473,430 | A | 9/1984 | Voltmer et al. | |
| 4,605,457 | A | 8/1986 | Guy | |
| 4,649,691 | A | 3/1987 | Buckholz | |
| 4,884,793 | A * | 12/1989 | Hurst | 271/2 |
| 5,088,718 | A * | 2/1992 | Stepan et al. | 271/161 |
| 5,191,751 | A | 3/1993 | Marzullo et al. | |
| 5,244,199 | A | 9/1993 | Wood | |
| 5,251,425 | A | 10/1993 | Kern | |
| 5,327,705 | A | 7/1994 | DeFigueiredo | |
| 5,487,254 | A | 1/1996 | Dronsfield | |
| 5,675,959 | A | 10/1997 | Hamma et al. | |
| 5,957,448 | A | 9/1999 | Frank et al. | |

(Continued)

FOREIGN PATENT DOCUMENTS

| | | |
|---|---|---|
| CA | 2 373 321 | 11/2000 |

(Continued)

OTHER PUBLICATIONS

Ole Henningsen; International Search Report and Written Opinion issued in related PCT Application No. PCT/US2009/030536; Jun. 3, 2009; 12 pages; European Patent Office.

(Continued)

*Primary Examiner*—Kaitlin S Joerger
(74) *Attorney, Agent, or Firm*—Wood, Herron & Evans, L.L.P.

(57) ABSTRACT

An apparatus for processing envelopes. A support plates and a pressure sensing lever support a stack of envelopes in a generally upright orientation. The pressure sensing lever pivots in accordance with pressure exerted by the stack of envelopes. A feeding apparatus is operatively coupled to a sensor such that pivotal movement of the pressure sensing lever is detected by the sensor and the feeding apparatus changes the pressure exerted against the stack of envelopes.

25 Claims, 10 Drawing Sheets

U.S. PATENT DOCUMENTS

| | | | | |
|---|---|---|---|---|
| 5,971,391 | A | 10/1999 | Salomon et al. | |
| 5,992,132 | A | 11/1999 | Auerbach | |
| 6,352,257 | B1 | 3/2002 | Todaro et al. | |
| 6,561,502 | B1 | 5/2003 | Flickner | |
| 7,077,397 | B2 * | 7/2006 | Stevens | 271/149 |
| 7,427,063 | B2 * | 9/2008 | Fairweather et al. | 271/149 |
| 2003/0025266 | A1 * | 2/2003 | Stevens | 271/149 |
| 2006/0156876 | A1 | 7/2006 | Sussmeier et al. | |
| 2006/0249895 | A1 | 11/2006 | Kern | |
| 2007/0040316 | A1 | 2/2007 | Kern | |
| 2008/0087147 | A1 | 4/2008 | Sussmeier et al. | |
| 2008/0106022 | A1 | 5/2008 | Sussmeier et al. | |

FOREIGN PATENT DOCUMENTS

| | | |
|---|---|---|
| DE | 37 00 112 | 7/1988 |
| DE | 298 13 546 | 11/1998 |
| EP | 0 253 995 | 1/1988 |
| EP | 0 504 114 | 9/1992 |
| EP | 0 876 908 | 11/1998 |
| EP | 1 108 563 | 6/2001 |
| EP | 1 297 970 | 4/2003 |
| EP | 1 622 778 | 11/2004 |
| EP | 1 683 651 | 7/2006 |
| WO | 2004/098905 | 11/2004 |

OTHER PUBLICATIONS

Ole Henningsen; International Search Report and Written Opinion issued in related PCT Application No. PCT/US2009/030559; Jun. 2, 2009; 11 pages; European Patent Office.

Third Office Action issued in related Chinese Patent Application No. 200380109842.0; Mar. 27, 2009; 8 pages; Chinese Patent Office.

Irina Becker; Invitation to Pay Additional Fees in related PCT patent application No. PCT/US2009/030538; Apr. 1, 2009; 5 pages; European Patent Office.

Irina Becker; Invitation to Pay Additional Fees in related PCT patent application No. PCT/US2009/030549; Apr. 8, 2009; 5 pages; European Patent Office.

* cited by examiner

ENVELOPE CONVEYING AND POSITIONING APPARATUS AND RELATED METHODS

CROSS-REFERENCE

This application is generally related to the following co-pending U.S. patent applications: Ser. No. 12/231,739, entitled "Apparatus for Guiding and Cutting Web Products and Related Methods;" Ser. No. 12/231,753, entitled "Inserting Apparatus for Discrete Objects into Envelopes and Related Methods;" Ser. No. 12/231,754, entitled "Transporting Apparatus for Discrete Sheets into Envelopes and Related Methods;" Ser. No. 12/231,730, entitled "Conveying Apparatus for Envelopes and Related Methods;" and Ser. No. 12/231,749, entitled "Transporting Apparatus for Web Products and Related Methods", all being filed on even date herewith and expressly incorporated herein by reference in their entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known devices which accomplish these and other functions. However, improvements are needed where high volumes of paper piece count and high speeds are required without sacrificing reliability accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In some such systems, envelopes are fed from a magazine or conveying device that applies a constant pressure against a stack of envelopes, and with the force required to remove one of the envelopes from the stack being thus fixed. This may result in a force that is too high or too low for the operation. If the pressure is too high, for example, other components of the system may be unable to remove an envelope from the stack without damaging the envelope.

Other such systems may include motors that turn on and off or that reverse in order to adjust the pressure exerted upon the stack of envelopes. Such systems may present limitations as to the attainable speeds of operation.

Accordingly, it is desirable to provide improved envelope conveying and positioning apparatus for a subsequent insertion of discrete paper or film objects into the envelopes in a high speed handling machine. It is also desirable to provide a converting apparatus and related methods that address inherent problems observed with conventional converting apparatus.

SUMMARY

To these ends, a preferred embodiment of the invention includes managing the bias force exerted against a substantially horizontal stack of envelopes toward a feed position by biasing the stack against a feed pressure sensor apparatus proximate a feed position and controlling the bias force in response to the sensed feed pressure.

More particularly, an apparatus for processing envelopes includes a support plate and a pressure sensing lever for supporting a stack of envelopes in a generally upright orientation. The pressure sensing lever pivots in accordance with pressure exerted by the stack of envelopes. In some embodiments, a feeding apparatus is operatively controlled by a sensor monitoring the pivoting of the sensing lever such that pivotal movement of the pressure sensing lever is detected by the sensor and the feeding apparatus is controlled to change the pressure exerted against the stack of envelopes in response to sensed pressure changes.

In one embodiment, an apparatus is provided for processing envelopes in a generally upright orientation. The apparatus includes a frame structure and a support plate that is mounted on the frame structure and which is generally stationary relative to the support plate. The support plate has a generally flat surface for supporting a generally horizontal stack of the envelopes in a generally upright orientation. A pressure sensing lever of the apparatus is mounted on the frame structure and has a sensing surface oriented transverse to the support plate, with the pressure sensing lever being pivotally mountable and moveable in response to pressure exerted by the stack of the envelopes. The pressure sensing lever is positioned relative to the support plate to permit a leading portion of a first envelope of the stack to extend into a region downstream of the sensing surface.

The apparatus may include a feeding apparatus for moving the stack toward the pressure sensing lever. A sensor is operatively coupled to control the stack bias or feeding apparatus. The sensor is configured to detect pivotal movement of the pressure sensing lever, with the feeding apparatus being responsive to a signal received from the sensor corresponding to the pivotal movement of the pressure sensing lever.

Preferably the pressure sensing lever is biased so its upper end engaging the lead-most envelope is biased in an upstream direction toward the envelope stack. The pressure sensing lever may include first and second elongate portions that are respectively disposed on opposite sides of a pivot, with the first portion including the sensing surface and the second portion being operatively coupled to or otherwise associated with the sensor, with the second portion being longer than the first portion. The apparatus may include a stop member in fixed orientation relative to the support plate and configured to orient the stack of envelopes at an acute angle relative to the support plate. The stop member may be configured to support a front surface of the first envelope of the stack. The stop member is oriented transversely to the support plate for supporting the stack of envelopes, with the feeding apparatus being configured to adjust the bias or pressure exerted on the envelopes toward the stop member in response to the signal received from the sensor.

The sensor may, for example, be an infrared sensor. The support plate may include at least one ramp for receiving envelopes of the stack fed by the feeding apparatus. The apparatus may additionally include an envelope pick-up element movable to engage the leading portion of the first envelope to thereby remove the first envelope from the stack. The envelope pick-up element may be rotatable to engage at least two discrete portions of the first envelope. The stop member may be adjustable in accordance with a pre-determined length of the envelopes.

In another embodiment, an automatic envelope stuffing apparatus is provided having a first end associated with feeding of a roll of paper, a processing apparatus for converting the roll of paper into discrete sheets, and a stuffing apparatus for inserting the discrete sheets into envelopes. The apparatus includes a frame structure, and a support plate mounted on the frame structure and generally stationary relative to the frame structure, with the support plate having a generally flat surface for supporting a stack of the envelopes in a generally upright orientation. A pressure sensing lever is mounted on the frame structure and has a sensing surface oriented transverse to the support plate, with the pressure sensing lever being pivotally movable in response to pressure exerted by the stack, with the pressure sensing lever being positioned relative to the support plate to permit a leading portion of a first envelope of the stack to extend into a region downstream of the sensing surface.

In yet another embodiment, a method is provided for processing stack of envelopes. The method includes applying a first force against a stack of envelopes to move them in a travel direction, and engaging a first envelope of the stack with a pivotally movable surface. The movable surface is pivotally moved in response to the first feed force and a second feed force is applied against a stack of envelopes that is different from the first force. Applying a second feed force may, for example, include applying a feed force that is lower than the first feed force. The second feed force may be applied in response to pivotal movement of the movable surface. The method may additionally or alternatively include moving the stack of envelopes in a generally upright orientation.

In another embodiment, a method is provided for feeding single envelopes from a stack of envelopes. The method includes biasing the stack toward an envelope feed position and sensing pressure on a lead envelope at the feed position resulting from the biasing. The biasing is controlled in response to the sensing.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved transporting apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;
(d) accumulating predefined stacks of discrete pieces of the insert;
(e) guiding and transporting a stack of discrete pieces of the insert toward an envelope-filling station;
(f) transporting individual envelopes toward the envelope-filling station;
(g) creating and processing a stack of the envelopes prior to the envelope-filling process; and
(h) processing an individual envelope from the stack of envelopes and through the envelope-filling station.

While the combination of the particular functions in the particular modules are unique combinations, the invention of this application lies primarily in the paper transporting apparatus and methods described herein.

DETAILED DESCRIPTION

Figure 1:
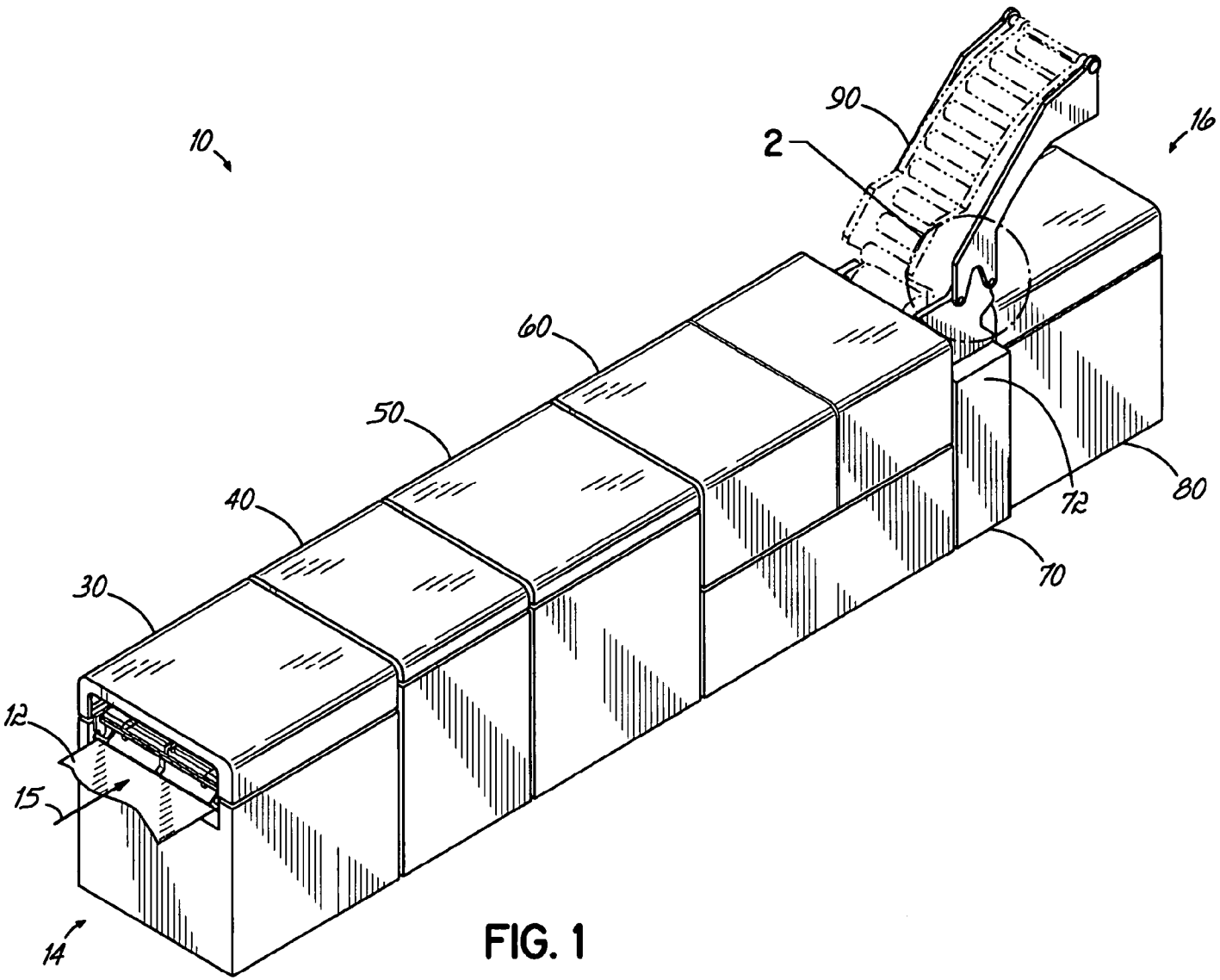
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar device. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (not shown) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
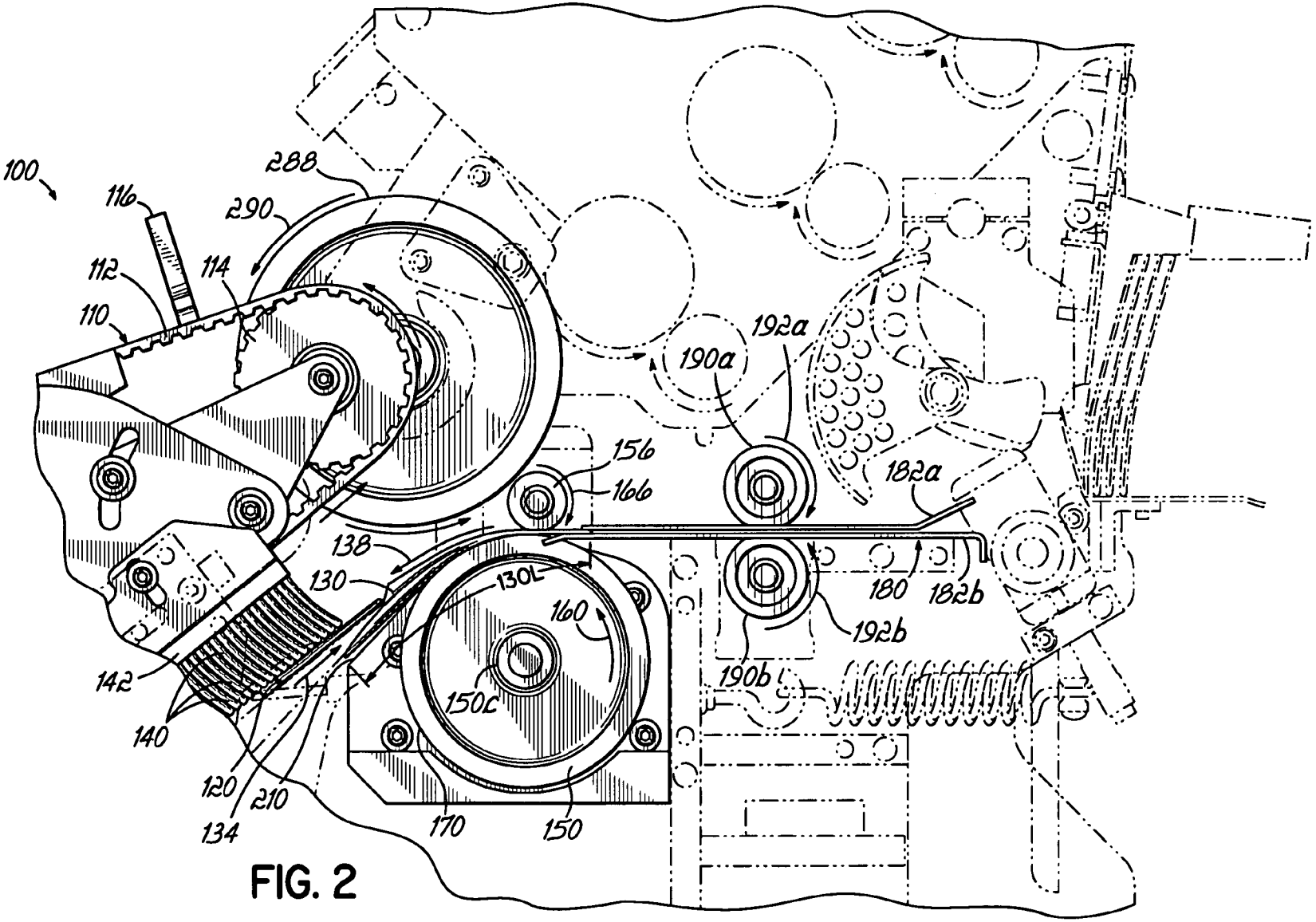
FIG. 2 is an elevation view of a portion of a stuffing or inserting apparatus of the converter of FIG. 1, more specifically associated with the encircled area 2 of FIG. 1.

With reference to FIG. 2, an exemplary stuffing module 70 is illustrated in greater detail. Module 70 includes a frame 72 that supports an inserting system or apparatus 100 that feeds the discrete sheets or inserts toward the envelopes, feeds the envelopes toward the discrete sheets, inserts the discrete sheets into the envelopes, and moves the stuffed envelopes toward the conveying assembly 90 (FIG. 1). To these ends, apparatus 100 includes a feeding apparatus 110 in the form of a belt assembly 112 rotatable in a closed loop (only partially shown) and driven by a toothed wheel 114. A plurality of fingers 116 extend from the belt assembly 112 and are spaced along the length of the belt assembly 112. Fingers 116 engage the trailing edges of inserts 120 to thereby move them toward envelopes 130 in the general direction of arrow 134 while the envelopes 130 are moved toward the inserts 120 in the general direction of arrow 138. A plurality of deflectable elements in the form, in this exemplary embodiment, of bristles 140, form part of support elements 142 of the feeding apparatus 110. The bristles 140 engage the inserts 120 as they move toward the envelopes 130.

As noted above, the envelopes 130 first move in the general direction of arrow 138 toward the inserts 120. This movement of the envelopes 130 is provided by cooperation between a rotating vacuum drum 150 and a rotating main roller 156 that nip each envelope 130. Vacuum drum 150 and main roller 156 are supported from a frame 158 (shown in phantom in FIG. 3) of stuffing module 70. When the vacuum drum 150 and main roller 156 rotate in directions opposite one another, the engagement with an envelope 130 disposed between them results in the envelope 130 moving toward the inserts 120 at an insertion or stuffing station. More specifically, the vacuum drum 150 rotates in the direction indicated by arrow 160 (counterclockwise) while the main roller 156 rotates in the direction indicated by arrow 166 (clockwise). A distance between the vacuum drum 150 and main roller 156 is suitably chosen to effectively nip an envelope 130 therebetween. In this regard, therefore, this distance is chosen based on factors including but not limited to a predetermined thickness of the envelopes 130. Although not shown, one or both of the vacuum drum 150 and main roller 156 may be adjustable to thereby permit adjustment of the distance between them.

The materials for vacuum drum 150 and main roller 156 are suitably chosen to permit engagement and movement of the envelopes in the direction of arrow 138. For example, and without limitation, at least an outer surface if not a substantial portion of the main roller 156 may be made of rubber, urethane or other materials providing a predetermined level of friction against the envelopes 130. Likewise, at least a surface 170 of vacuum drum 150 is made out of a metal such as stainless steel, which may further be coated with a release-type surface or texture to prevent, for example, build-up of adhesive or other materials on the surface 170.

Vacuum drum 150 and main roller 156 receive each envelope from guides 180 (only one shown in the view of FIG. 2) defined by oppositely disposed rails 182*a*, 182*b* that guide the envelopes 130. More specifically, rails 182*a*, 182*b* define a space between them that receives the lateral portions 130*a*

(FIG. 4) of each envelope 130. Two pairs (only one shown) of driven secondary rollers 190*a*, 190*b* are positioned between the guides 180 to facilitate movement of the envelopes guided by guides 180. More specifically, rollers 190*a*, 190*b* rotate in directions opposite one another (arrows 192*a*, 192*b*) and are positioned to nip a center portion of the envelopes 130 to thereby move the envelopes 130 toward the inserts 120.

Figure 3:
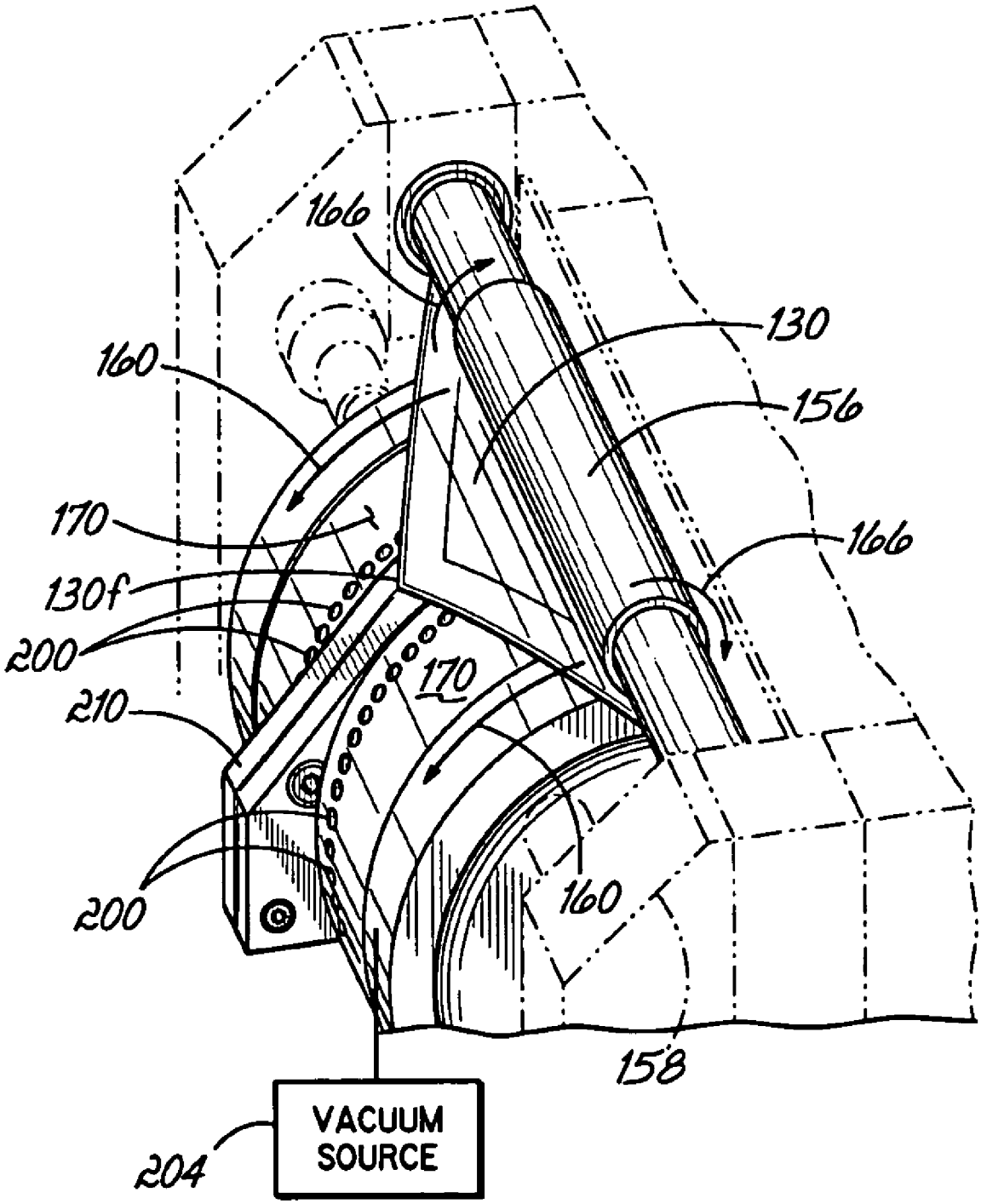
FIG. 3 is a perspective view of a vacuum drum and main roller of the inserting apparatus of FIG. 2.

With continued reference to FIG. 2 and with additional reference to FIG. 3, vacuum drum 150 includes a plurality of holes 200 on the surface 170 and configured to permit movement of the envelopes 130 with rotation of vacuum drum 150. More particularly, holes 200 are in fluid communication with a schematically-depicted vacuum source 204 to generate a negative pressure at the surface 170 of the vacuum drum 150. The negative pressure engages the envelopes 130 thereby retaining the envelopes 130 and preventing or minimizing movement of the envelopes 130 relative to vacuum drum 150 as vacuum drum 150 rotates.

In this exemplary embodiment, the vacuum source 204 is continuously operating i.e., it is continuously in an "ON" condition. Moreover, the vacuum drum 150 is electrically controlled, for example, servo-controlled to facilitate the selective application of negative pressure against selected groups of the holes 200 and thus, selected portions of the surface 170 of vacuum drum 150. Selection of the holes 200 to which the vacuum source 204 directs the negative pressure is chosen, for example, based on a pitch or length 130L of the envelopes 130. In this regard, the vacuum drum 150 can be rotated relative to the vacuum source 204 to align vacuum source 204 with the desired group of holes 200 that enable engagement, by rotating surface 170, of a particular type of envelope 130 and/or a selected portion of the envelope 130. For example, vacuum drum 150 can be rotated relative to the vacuum source 204 such that negative pressure is not applied to the trailing portion of the envelope 130, which may facilitate release of the envelope 130 from vacuum source 204.

Vacuum drum 150 includes two lateral portions 150*a*, 150*b* having similar structures and rotatable from a common central core 150*c*. The holes 200, in this regard, are positioned on both of the lateral portions 150*a*, 150*b* to thereby permit even engagement of the envelopes 130. Accordingly, the exemplary arrangement of holes 200 in this embodiment prevents or at least minimizes skewing of the envelopes 130 as they travel with rotation of the vacuum drum 150.

With continued reference to FIGS. 2-3, a ramp element 210 is coupled to the vacuum drum 150 to permit release of the envelopes 130 from the surface 170 of vacuum drum 150. More specifically, ramp element 210 is stationary relative to the vacuum drum 150 and is positioned between the two lateral portions 150*a*, 150*b* of vacuum drum 150. Ramp element 210 is in the form of a solid block having a surface that is generally tangential to the surface 170 of vacuum drum 150. In operation, as an envelope 130 moves with rotation of vacuum drum 150 (arrows 160), a leading portion 130*f* of the envelope 130 rides over the ramp element 210 to thereby disengage the leading portion 130*f* away from the surface 170 of vacuum drum 150.

Those of ordinary skill in the art will appreciate that, alternatively, ramp element 210 could take other forms, so long as it is arranged to be generally tangential to the surface 170 of vacuum drum 150. Likewise, it is contemplated that ramp element 210 could be alternatively a moving element, rather than completely stationary, so long as it is stationary relative to the vacuum drum 150. For example, and without limitation, an alternative embodiment may include a ramp element that moves in the same or opposite direction relative to the vacuum drum so as to define a stationary ramp element relative to vacuum drum 150.

Figure 4A:
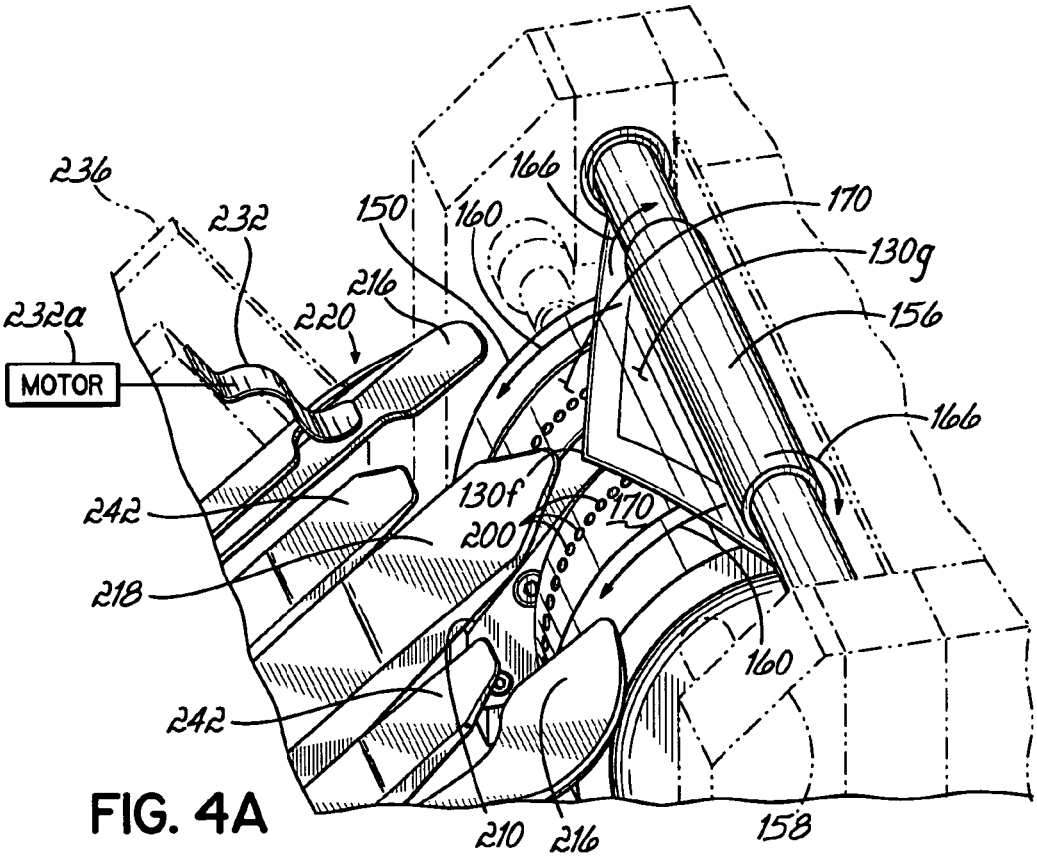
FIG. 4A is a view similar to FIG. 3, additionally showing a sheet inserting assembly of the inserting apparatus of FIG. 2.

With reference to FIGS. 4A-4D, an exemplary inserting operation is illustrated. FIG. 4A depicts an envelope 130 moving with rotation (arrows 160) of the vacuum drum 150. Holes 200 are in engagement with most of the length of envelope 130. The orientation of envelope 130 is such that the leading portion 130*f* thereof is a flap of the envelope. Moreover, the orientation is such that the substrate of paper 130*g* defining the flap of the envelope 130 faces the surface 170 of vacuum drum 150, while an opposite substrate 130*h* (FIG. 4B) faces the main roller 156. Those of ordinary skill will appreciate that this orientation is merely exemplary and other alternative orientations may be substituted instead.

FIG. 4A also shows the leading portion 130*f* of envelope 130 beginning to engage ramp element 210. Envelope 130 is moreover shown moving toward a pair of outer extension elements 216 and a central extension element 218 of a transporting apparatus 220. Transporting apparatus 220 conveys the inserts 120 (FIG. 4B) toward the envelope 130 and includes the feeding apparatus 110 and support elements 142 (FIG. 2) described above. In this exemplary embodiment, moreover, transporting apparatus 220 includes a pair of clips 232 (only one shown) extending from a frame 236 (shown in phantom) of apparatus 220. Transporting apparatus 220, in this embodiment, also includes a pair of guide elements 242 that facilitate guidance of the inserts 120 into an envelope 130. The positions of clips 232 are controlled by schematically-depicted motors 232*a* (only one shown) operatively coupled through jack screws (not shown) to the clips 232 and which permit automatic adjustment of the positions of clips 232 in response to the length 130L of the envelopes 130. More specifically, motors 232*a* facilitate adjusting a position of clips 232 toward and away from main roller 156. Motors 232*a* may, for example, be stepper motors such as model HRA08C available from Sick Stegmann GmbH, a member of the Sick AG Group of Waldkirch, Germany.

Figure 4B:
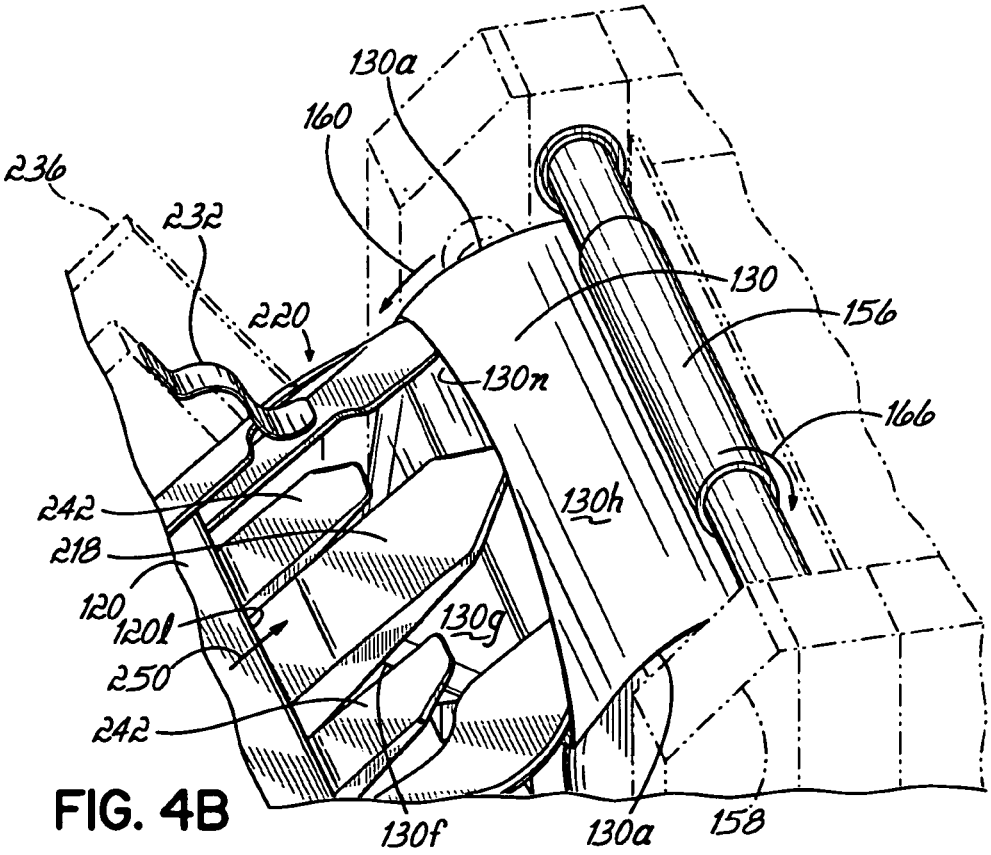
FIG. 4B is a view similar to FIG. 4A showing an envelope in a different position relative to that shown in FIG. 4A.

With particular reference to FIG. 4B, the envelope 130 is shown having partially engaged the extension elements 216, 218 in such a way that extension elements 216, 218 extend into an interior portion 130*n* of the envelope 130. At this stage of the inserting process, and relative to the stage shown in FIG. 4A, a greater portion of the length 130L (FIG. 2) of the envelope 130 has engaged the ramp element 210 and is accordingly disengaged from surface 170 of vacuum drum 150.(FIG. 4A). At this stage, likewise, insert 120 is shown moving, in the direction of arrow 250, toward the interior portion 130*n* of envelope 130. The insert 120 is shown with a leading edge 120L thereof headed toward the interior portion 130*n*.

Figure 4C:
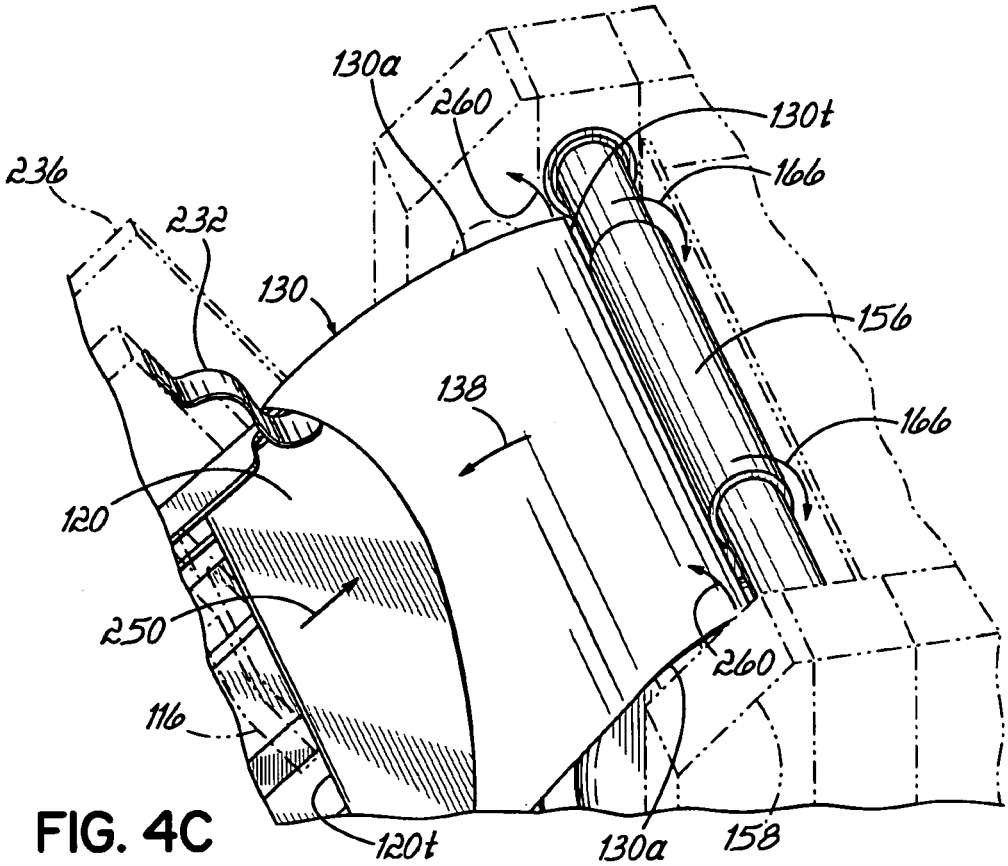
FIG. 4C is a view similar to FIGS. 4A-4B; showing the envelope thereof in yet a different position.
Figure 4D:
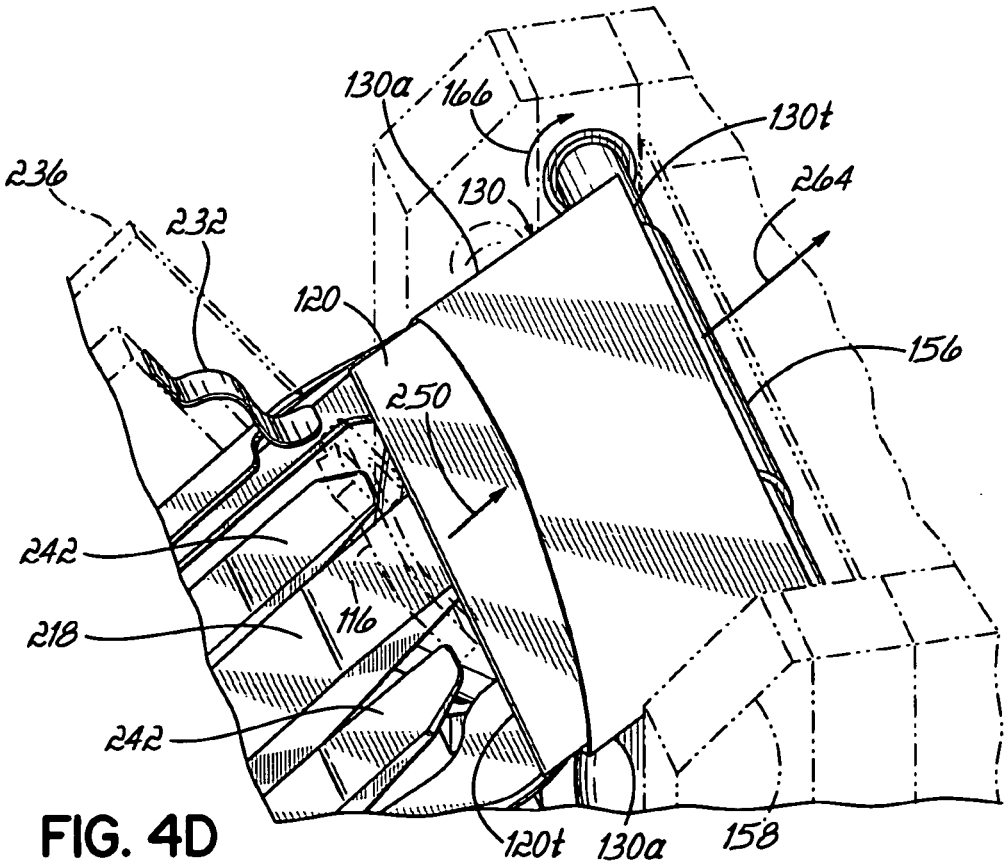
FIG. 4D is a view similar to FIGS. 4A-4C, showing the envelope thereof in yet a different position relative to FIGS. 4A-4C.

With particular reference to FIG. 4C, a stage of the inserting process is shown in which the envelope 130 is completely or at least mostly disengaged from the surface 170 of vacuum drum 150 (FIG. 4A). In this regard, rotation of vacuum drum 150 is such that envelope 130 slips relative to the rotational motion of vacuum drum 150. Clips 232 (only one shown) is depicted engaging envelope 130 so as to provide a stopping or limiting surface in the movement (arrow 138) of envelope 130 toward insert 120. Fingers 116 (shown in phantom) are depicted engaging a trailing edge 120*t* of insert 120 and thereby moving the insert 120 (arrow 250) toward the interior portion 130*n* of envelope 130. Clips 232, moreover, provide a lifting action for the envelope 130 such that, upon further movement of envelope 130 in the direction of arrow 138, a trailing edge 130*t* of envelope 130 is forced upward (arrows 260) and above the main roller 156, as shown in FIG. 4D. As used herein, the terms "upward," "upper," "lower," "above," "forward," "front," "back," and derivatives thereof are not intended as limiting but rather merely reflect the illustrative orientations shown in the figures.

With particular reference to FIG. 4D, a stage of the inserting process is shown in which forward movement of the fingers 116 (arrow 250) results in movement of the envelope in a similar direction (arrow 264) generally away from the transporting apparatus 220 at the insertion or stuffing station and toward the conveying assembly 90 (FIG. 1), for further disposition of the stuffed envelope 130. More specifically, at the stage of the process depicted in FIG. 4D, the leading edge 120L of insert 120 has reached the trailing edge 130*t* of envelope 130. Accordingly, forward movement of the fingers 116 exerts a force, through insert 120, upon trailing edge 130*t* of envelope 130, thereby resulting in movement of the stuffed envelope 130 in the direction of arrow 264.

Figure 5:
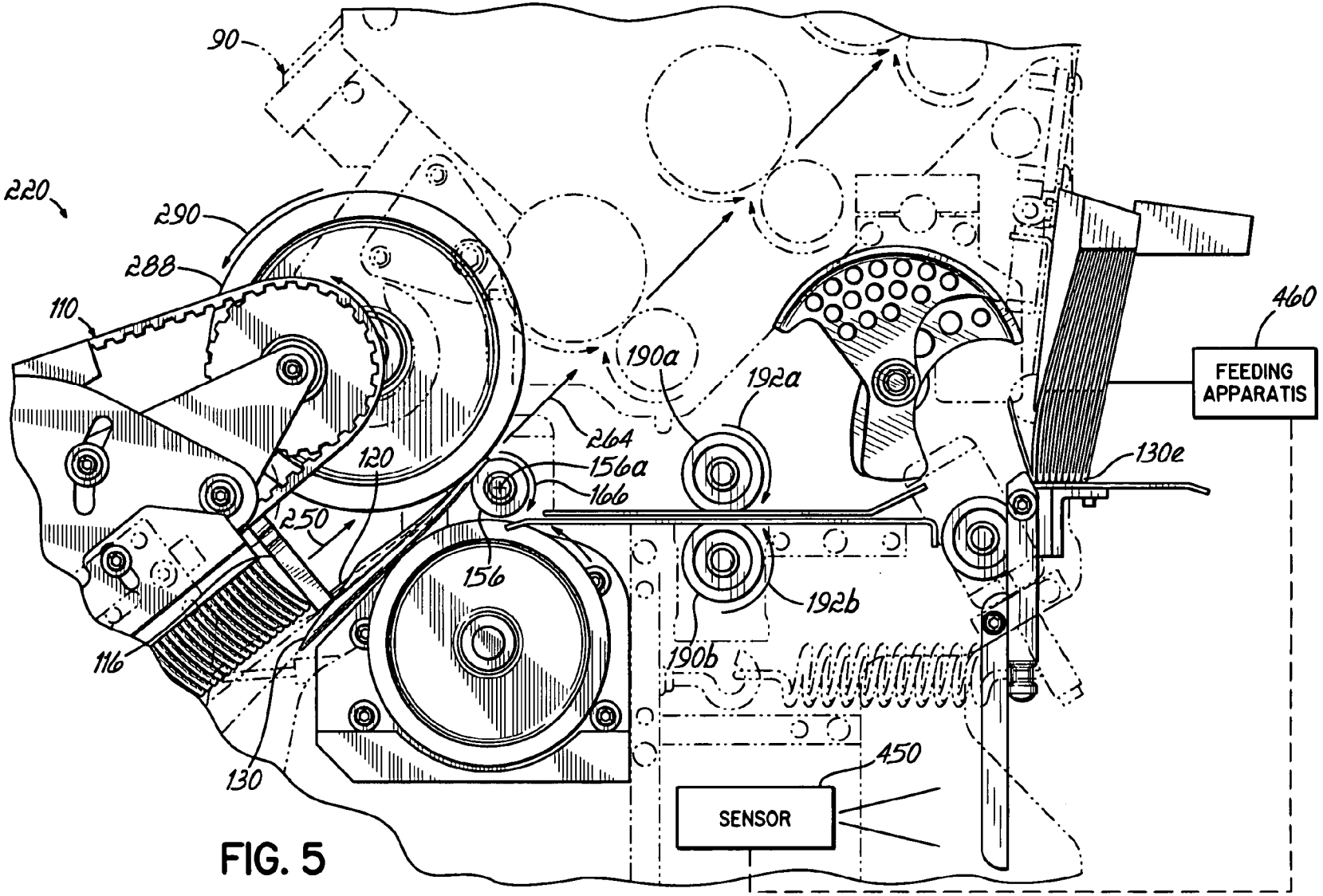
FIG. 5 is a view similar to FIG. 2 showing a stage of an inserting process.

With continued reference to FIG. 4D and with further reference to FIG. 5, rotation of the main roller 156 (arrow 166) cooperates to move the stuffed envelope 130 in the direction of arrow 264. More particularly, a rotating conveying roller 288 is disposed so as to define a small space between conveying roller 288 and main roller 156. Conveying roller 288 may alternatively be in the form of any other rotating element such as, for example, an irregularly-shaped rotating element and thus not limited to circular rotating element as depicted in this embodiment. Conveying roller 288 rotates in a direction (arrow 290) opposite that of main roller 156. The position of conveying roller 288 as well as its direction of rotation (arrow 290) relative to the direction of rotation (arrow 166) of main roller 156 permit nipping engagement of the stuffed envelope 130 and conveying thereof in the direction of arrow 264. In this particular embodiment, conveying roller 288 rotates in a counterclockwise direction, although this is not intended to be limiting but rather exemplary. Accordingly, rotation of the main roller 156 in the direction of arrow 166 enables movement of the envelope 130 in a first direction (arrow 138) during a stage of the inserting process while enabling movement of the envelope 130 in a second direction (arrow 250) opposite the first direction (arrow 138) and in an opposite side of an axis 156*a* of rotation of main roller 156 during a different stage of the process.

With reference to FIGS. 6-8, 8A, and 9, and as discussed above, the secondary rollers 190*a*, 190*b* engage a central portion of each envelope 130 to thereby move the envelopes 130 along the guides 180. In this regard, the envelopes 130 enter the guides 180 by action of a rotating pick-up element 320 that engages the leading portion 130*f*, of each of the envelopes 130. More particularly, pick-up element 320 is an irregularly shaped rotating structure having a central portion 322 and outer portions 324, both of which include respective circumferential surfaces 322*a*, 324*a* for engaging the envelopes 130.

The central portion 322 is circumferentially positioned in front of the outer portions 324, relative to the direction of rotation (arrow 352) thereof. Moreover, the central portion 322 of this exemplary embodiment is separately movable relative to the outer portions 324 such that the positions of these two portions 322, 324 of the pick-up element 320 can be adjusted relative to one another. Adjustment may be desirable, for example, to accommodate envelopes having different lengths 130L. Pick-up element 320 is positioned adjacent an envelope stack supporting apparatus to jointly define an envelope conveying apparatus 350, the details of which are discussed in further detail below.

Pick-up element 320 rotates, in this exemplary embodiment, and as noted above, in the direction of arrow 352. In this regard, and with particular reference to the stage of the process shown in FIG. 6, a leading portion, in this embodiment, in the form of a flap 131*f* of a first envelope 131 of a stack of envelopes 130 is shown prior to engagement thereof by pick-up element 320. Moreover, the first envelope 131 is shown oriented such that the flap 131*f* is hingedly movable generally in the direction of arrow 360.

Figure 7:
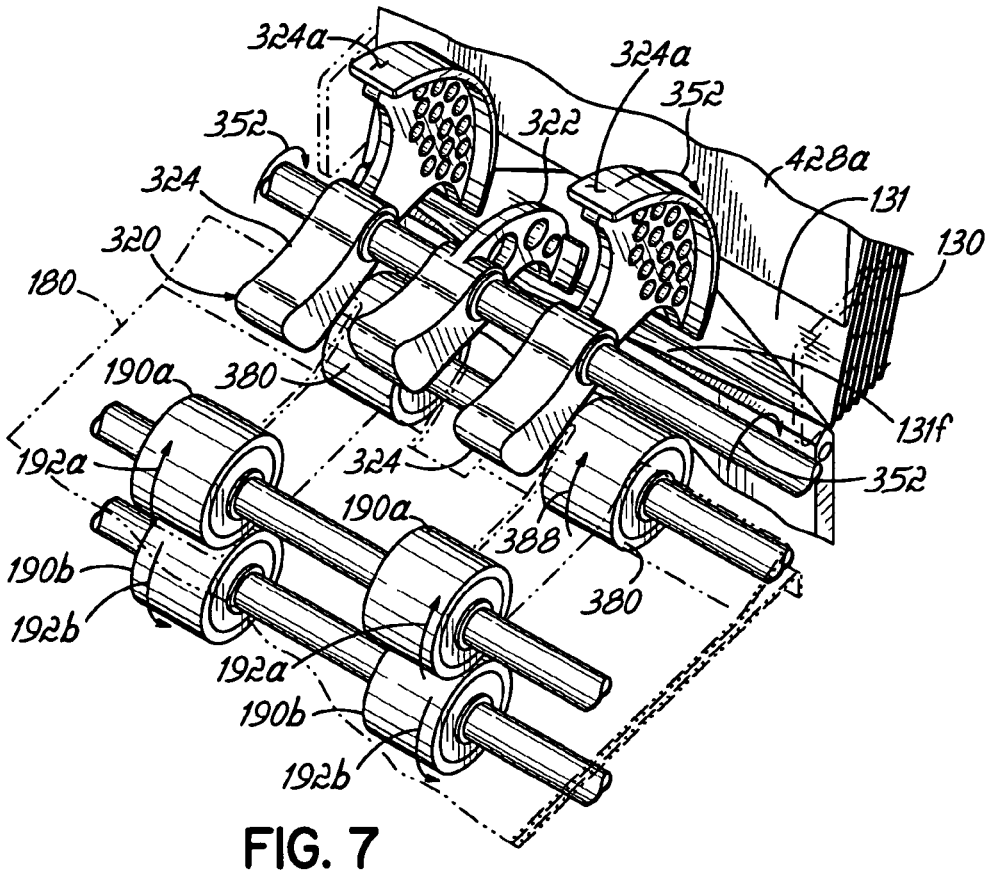
FIG. 7 is a perspective view of a portion of the envelope conveying apparatus of FIG. 6.

With particular reference to FIG. 7, the pick-up element 320 is shown having partially engaged envelope 131. More particularly, the central portion 322 of pick-up element 320 is shown having rotated sufficiently to engage the flap 131*f* of the first envelope 131, thereby causing flap 131*f* to hingedly rotate in the direction of arrow 360. Moreover, outer portions 324 are shown prior to engaging the first envelope 131.

Figure 8A:
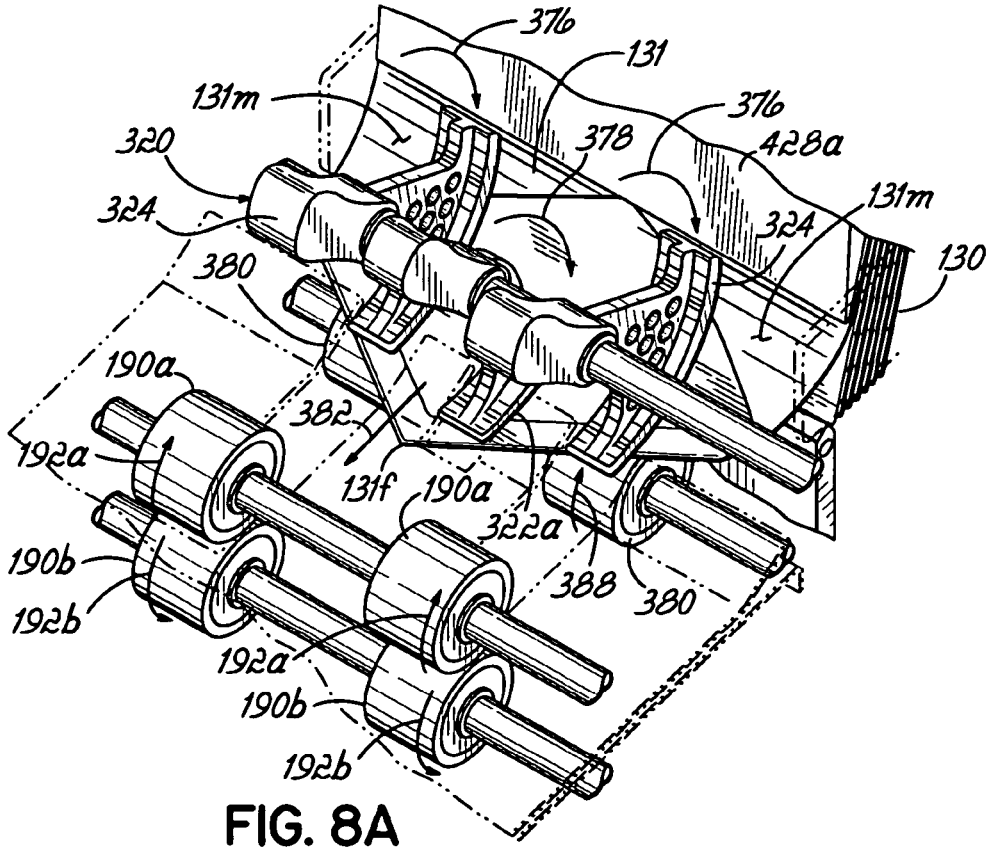
FIG. 8A is a view similar to FIG. 7 showing a portion of the envelope conveying apparatus at the stage illustrated in FIG. 8.
Figure 8:
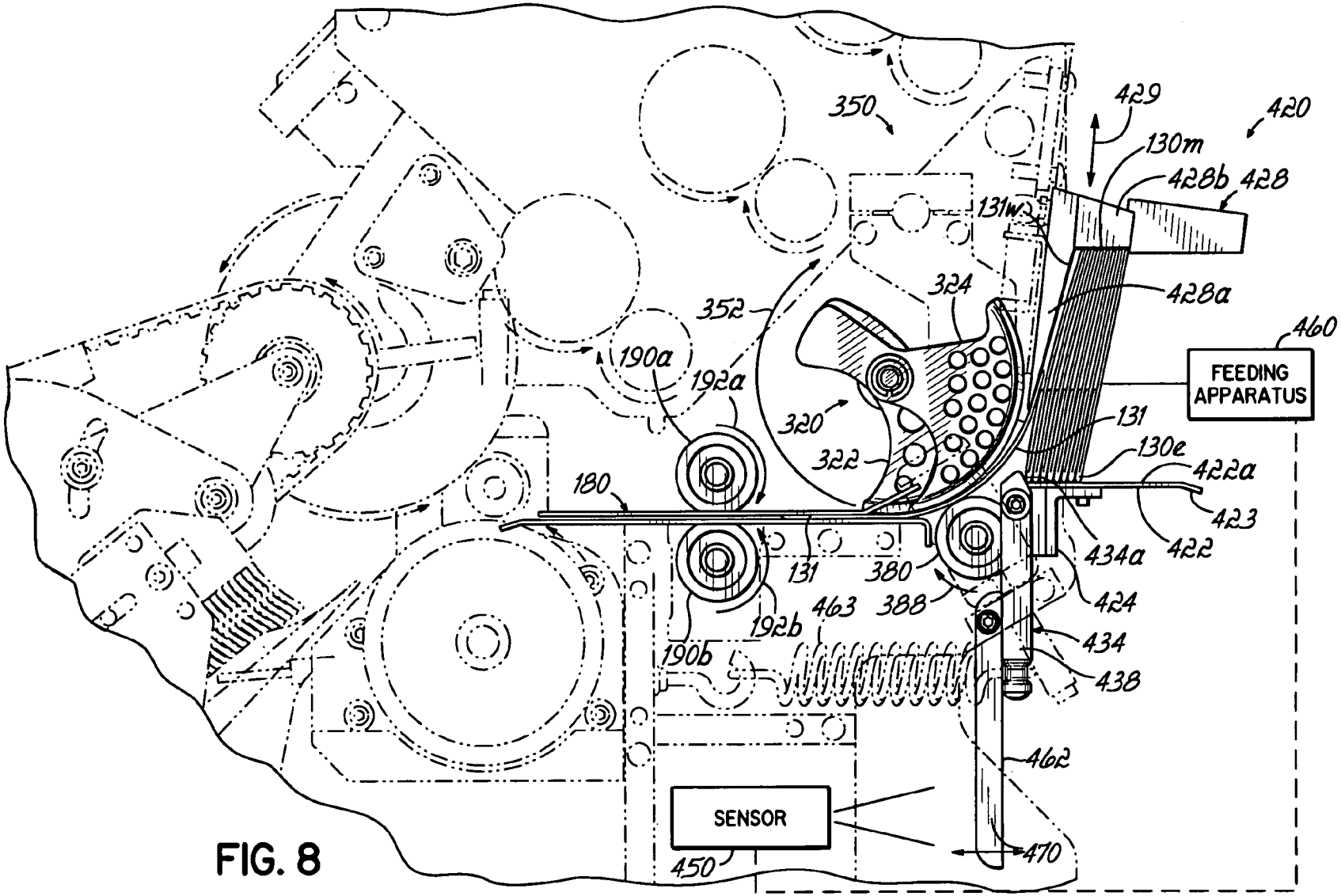
FIG. 8 is a view similar to FIG. 6, showing a stage in a process for conveying envelopes.

With particular reference to FIGS. 8-8A, pick-up element 320 is shown having rotated (arrows 376, 378) further in the direction of arrow 352 such that the central portion 322 and the outer portions 324 have engaged the flap 131*f* of the first envelope 131. In this regard, rotation of the outer portions 324 results in engagement of outer portions 324 with a set of follower rollers 380 made, for example and without limitation, of rubber or urethane. The position of the follower rollers 380 relative to outer portions 324 is such that they jointly nip the flap 131*f*, causing rotation of follower rollers 380 (arrow 388) and forward movement of the envelope 131 in the direction of arrow 382. FIGS. 8-8A also show partial engagement, by pick-up element 320, of discrete portions 131*m* of envelope 131. Engagement of discrete portions 131*m* other than flap 131*f* facilitate a smooth conveyance of envelope 131 toward the guides 180.

Figure 9:
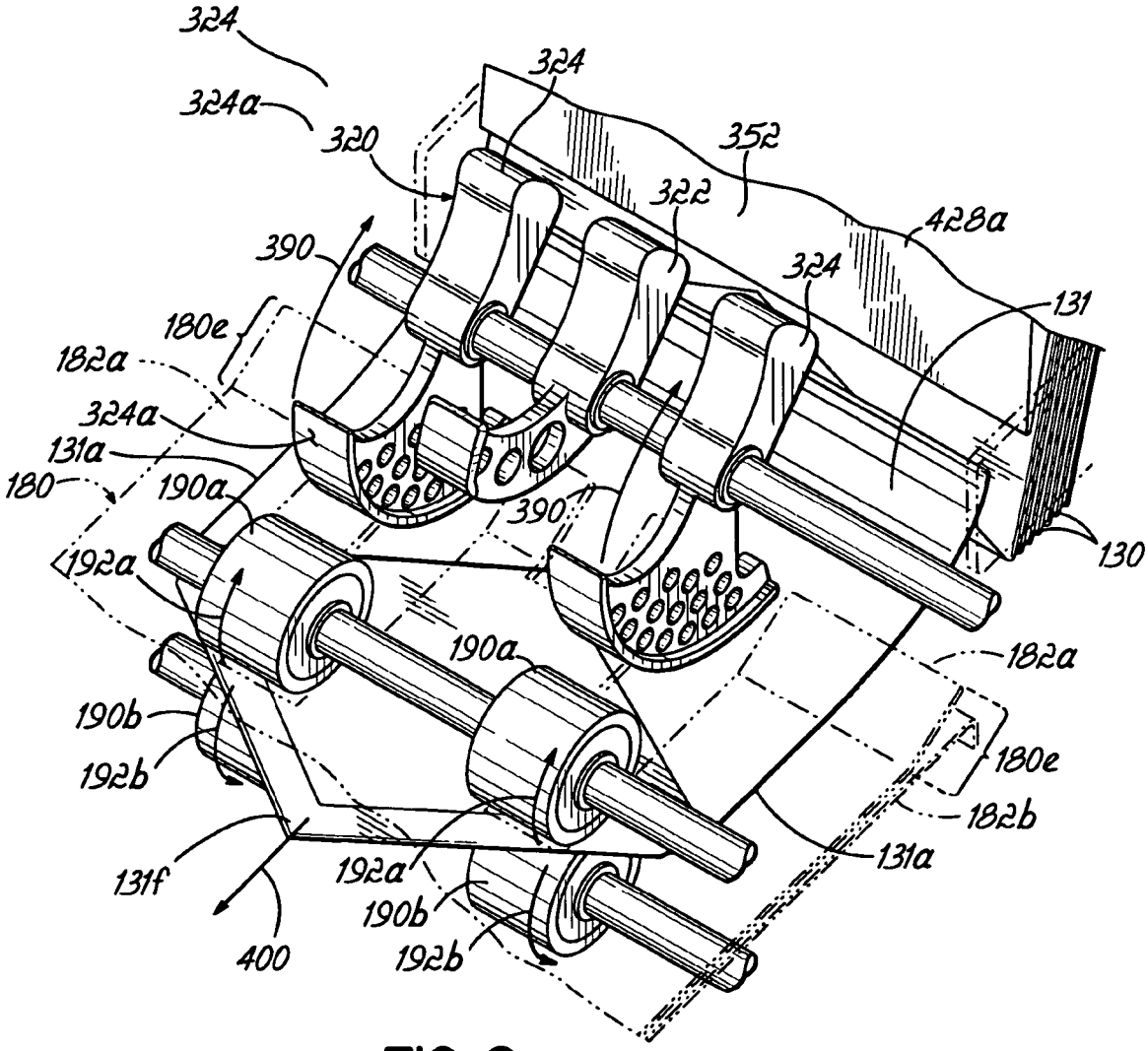
FIG. 9 is a view similar to FIGS. 7 and 8A, showing a different stage in the processing for conveying envelopes.

With particular reference to FIG. 9, pick-up element 320 is shown having rotated (arrows 390) further relative to the view of FIGS. 8-8A. The envelope 131 is shown in a position such that the lateral portions 131*a* thereof have entered guides 180 (shown in phantom). In this regard, the rails 182*a*, 182*b* of guides 180 are angled relative to one another in an entry portion 180*e* of guides 180 to facilitate movement of the lateral portions 131*a* into the space defined between rails 182*a*, 182*b*. In the shown view, moreover, central portion 322 of pick-up element is no longer in engagement with envelope 131, while outer portions 324 are rotating away from envelope 131 and thereby disengaging from envelope 131. Although not shown, as pick-up element 320 continues to rotate (arrows 390), it engages a new first envelope 131 from the stack of envelopes 130.

Referring again to FIG. 6, pick-up element 320 removes the first envelope 131 from a stack of envelopes supported by an envelope conveying system 420 that feeds envelopes 130 in a continuous fashion. Envelope conveying system 420 includes a support plate 422 mounted on and stationary relative to a frame structure 424. Support plate includes a generally flat surface 422*a* that is adapted to support a generally horizontal stack of the envelopes 130, each in a generally upright orientation. Moreover, in this exemplary embodiment, support plate 422 includes a ramp 423 to facilitate receiving envelopes 130. As used herein, the terms "upright" and "generally horizontal" are not intended to be respectively restricted to perfectly vertical or horizontal orientations of the envelopes 130 or the stack thereof, but rather an orientation whereby they are supported edgewise. In this regard, therefore, and as shown in FIG. 6, the envelopes 130 are supported edgewise (along lower edges 130*e*) in a generally upright orientation though defining an acute angle relative to the support plate surface 422*a*.

A stop member 428 of the envelope conveying system 420 is similarly supported from the frame structure 424 and is mounted in a fixed orientation relative to the support plate 422. Stop member 428 includes a forward portion 428*a* that supports a front or forward facing face 131*w* of the first envelope 131 of the stack of envelopes 130. A top portion 428*b* of the stop member 428 supports upper edges 130*u* of the envelopes 130. In this regard, the stop member 428 is vertically adjustable (arrow 429) to accommodate envelopes 130 of different pitches or lengths 130L. A schematically-depicted motor 430 is operatively coupled through a jack screw (not shown) to stop member 428 to facilitate automatic adjustment of the vertical position of stop member 428 in response to length 130L. For example, and without limitation, motor 430 may be a stepper motor model HRA08C available from Sick Stegmann GmbH, a member of the Sick AG Group of Waldkirch, Germany. Jointly, the stop member 428 and the support plate 422 support the envelopes 130 in the generally upright orientation shown in FIG. 6.

Figure 6:
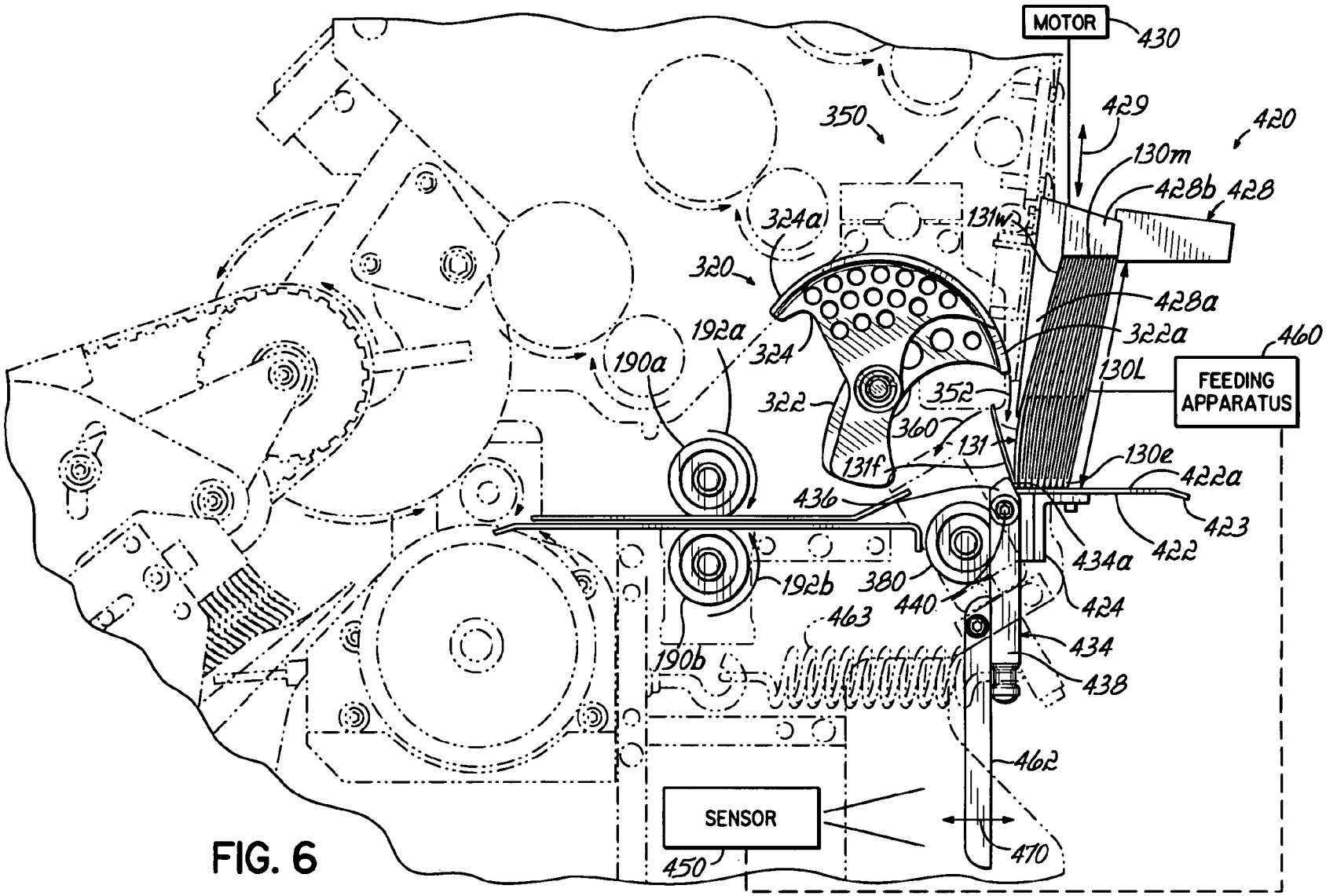
FIG. 6 is a view similar to FIGS. 2 and 5, showing a portion of an envelope conveying apparatus.

With continued reference to FIG. 6, a pressure sensing lever 434 of the envelope conveying system 420 is oriented generally transversely to the support plate 422 and is pivotally movable about a pivot 440 fixedly coupled to the frame structure 424. Pressure sensing lever 434 includes a sensing surface 434*a* that engages the first envelope 131 of the stack of envelopes 130. Pressure sensing lever 434 has a first portion 436 that includes the sensing surface 434*a* and extending from the pivot 440. A second portion 438 of the pressure sensing lever 434 also extends from the pivot 440 and away from the first portion 436. In this embodiment, the first portion 436 is shorter than the second portion 438. In operation, the first envelope 131 is in a feed position and oriented such that the flap 131 f of the first envelope 131 extends into a region downstream of (i.e., behind) the sensing surface 434*a*.

A schematically-depicted sensor 450 is operatively coupled to, or in a position to sense, the second portion 438 for controlling a feeding apparatus 460 of the envelope conveying system 420. Feeding apparatus 460 exerts a feed force upon the stack of envelopes 120 that biases the stack toward the envelope feed position shown in FIG. 6. The sensor 450 is in this embodiment an infrared-type sensor, positioned to aim at an extension 462 coupled to the second portion 438 of pressure sensing lever 434 and configured to detect movement of the extension 462. In this exemplary embodiment, extension 462 is coupled to the frame structure 424 through a spring and hook assembly 463 (shown in phantom) to guide movement of extension 462 along the directions of arrow 470, and with a predetermined spring bias to hold the pressure sensing lever 434 against the first (i.e., lead) envelope 131. In this regard, movement of the extension 462 (arrow 470) results from a corresponding movement of the first portion 436 of pressure sensing lever 434 and which is caused by a feed force exerted by the stack of envelopes 130 against sensing surface 434*a*.

More specifically, the force exerted by the stack of envelopes 130 upon sensing surface 434*a* results from a feed or bias force applied against the stack by the feeding apparatus 460. This feed or bias force, in turn, determines the amount of pressure acting on the first envelope 131 held between the other envelopes 130 of the stack and the forward portion 428*a* of stop member 428. The pressure acting on the first envelope 131, in turn, determines the force necessary to remove the first envelope 131 from the stack of envelopes 130.

In this embodiment, the feeding apparatus 460 is operatively coupled to the sensor 450. In this regard, when sensor 450 detects movement of the extension 462 (arrow 470), sensor 450 sends a corresponding signal to feeding apparatus 460. In response to this signal, feeding apparatus 460 decreases or increases the amount of feed force it applies against the stack of envelopes 130 and thus, the pressure acting on the pressure sensing lever 434 and stop member 428. Accordingly, the feeding apparatus 460 is capable of controlling the pressure acting upon the first envelope 131 of the stack of envelopes 130 to thus maintain it at a predetermined desired level to facilitate removal of the first envelope 131 from the stack. For example, and without limitation, the feeding apparatus may, during operation, feed the envelopes 130 with a first feed force and a corresponding pressure exerted against the forward portion 428*a* of stop member 428. This first force results in pivotal movement of the pressure sensing lever 434. The sensor 450 detects the movement of extension 462 associated with the first force. Sensor 450, in turn, sends a corresponding signal to the feeding apparatus 460 which, in response to the signal, adjusts the feed force with which it feeds the envelopes 130, for example to a lower, second feed force. This lower second force results in a lower pressure exerted against forward portion 428*a* of stop member 428 which, in turn, results in a smaller deflection of pressure sensing lever 434.

While the present invention has been illustrated by a description of various embodiments and while these embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for processing envelopes in a generally upright orientation, comprising:

a frame structure;

a support plate mounted on said frame structure and stationary relative thereto, said support plate having a generally flat surface for supporting a stack of the envelopes in a generally upright orientation as the envelopes move in a travel direction, and a pressure sensing lever mounted on said frame structure and having a sensing surface oriented transverse to said support plate, said pressure sensing lever being pivotally movable in response to pressure exerted by the stack of the envelopes, said pressure sensing lever positioned relative to said support plate to permit a leading portion of a first envelope of the stack to extend into a region downstream of said sensing surface in the travel direction, the leading portion of the first envelope extending transversely to a remainder of the first envelope.

2. The apparatus of claim 1, further comprising:

a feeding apparatus for moving the stack toward said pressure sensing lever; and a sensor operatively coupled to said feeding apparatus and configured to detect pivotal movement of said pressure sensing lever, said feeding apparatus being responsive to a signal received from said sensor corresponding to the pivotal movement of said pressure sensing lever.

3. An apparatus for processing envelopes in a generally upright orientation, comprising:

a frame structure;

a support plate mounted on said frame structure and generally stationary relative thereto, said support plate having a generally flat surface for supporting a stack of the envelopes in a generally upright orientation;

a pressure sensing lever mounted on said frame structure and having a sensing surface oriented transverse to said support plate, said pressure sensing lever being pivotally movable in response to pressure exerted by the stack of the envelopes, said pressure sensing lever positioned relative to said support plate to permit a leading portion of a first envelope of the stack to extend into a region behind said sensing surface; and a stop member in fixed orientation relative to said support plate and configured to orient the stack of envelopes at an acute angle relative to said support plate.

4. The apparatus of claim 3, wherein said stop member is configured to support a front surface of the first envelope.

5. An apparatus for processing envelopes in a generally upright orientation, comprising:

a frame structure;

a support plate mounted on said frame structure and generally stationary relative thereto, said support plate having a generally flat surface for supporting a stack of the envelopes in a generally upright orientation, and a pressure sensing lever mounted on said frame structure and having a sensing surface oriented transverse to said support plate, said pressure sensing lever being pivotally movable in response to pressure exerted by the stack of the envelopes, said pressure sensing lever positioned relative to said support plate to permit a leading portion of a first envelope of the stack to extend into a region behind said sensing surface, wherein said pressure sensing lever includes first and second elongate portions respectively disposed on opposite sides of a pivot thereof, said first portion including said sensing surface, said second portion operatively coupled to said sensor, said second portion being longer than said first portion.

6. The apparatus of claim 2, further comprising:

a stop member oriented transversely to said support plate for supporting the stack of envelopes, said feeding apparatus being configured to adjust the pressure exerted by the stack of envelopes onto said stop member in response to the signal received from said sensor.

7. The apparatus of claim 2, wherein said sensor is an infrared sensor.

8. The apparatus of claim 1, wherein said support plate includes at least one ramp for receiving envelopes of the stack fed by said feeding apparatus.

9. The apparatus of claim 1, further comprising:

an envelope pick-up element movable to engage the leading portion of the first envelope to thereby remove the first envelope from the stack.

10. The apparatus of claim 9, wherein said envelope pick-up element is rotatable to engage at least two discrete portions of the first envelope.

11. An apparatus for processing envelopes in a generally upright orientation, comprising:

a frame structure;

a support plate mounted on said frame structure and generally stationary relative thereto, said support plate having a generally flat surface for supporting a stack of the envelopes in a generally upright orientation;

a pressure sensing lever mounted on said frame structure and having a sensing surface oriented transverse to said support plate, said pressure sensing lever being pivotally movable in response to pressure exerted by the stack of the envelopes, said pressure sensing lever positioned relative to said support plate to permit a leading portion of a first envelope of the stack to extend into a region behind said sensing surface; and a stop member oriented transversely to said support plate for supporting the stack of envelopes, said stop member being adjustable in accordance with a predetermined length of the envelopes.

12. The apparatus of claim 11, further comprising:

a motor operatively coupled to said stop member for automatically adjusting a position of said stop member in response to the length of the envelopes.

13. An automatic envelope stuffing apparatus having a first end associated with feeding of a roll of paper, a processing apparatus for converting the roll of paper into discrete sheets, and a stuffing apparatus for inserting the discrete sheets into envelopes, further comprising;

a frame structure;

a support plate mounted on said frame structure and stationary relative thereto, said support plate having a generally flat surface for supporting a stack of the envelopes in a generally upright orientation as the envelopes move in a travel direction, and a pressure sensing lever mounted on said frame structure and having a sensing surface oriented transverse to said support plate, said pressure sensing lever being pivotally movable in response to pressure exerted by the stack, said pressure sensing lever positioned relative to said support plate to permit a leading portion of a first envelope of the stack to extend into a region downstream of said sensing surface in the travel direction, the leading portion of the first envelope extending transversely to a remainder of the first envelope.

14. The apparatus of claim 13, further comprising:

a feeding apparatus for moving the stack toward said pressure sensing lever; and a sensor operatively coupled to said feeding apparatus and configured to detect pivotal movement of said pressure sensing lever, said feeding apparatus being responsive to a signal received from said sensor corresponding to the pivotal movement of said pressure sensing lever.

15. The apparatus of claim 14, wherein said pressure sensing lever includes first and second elongate portions respectively disposed on opposite sides of a pivot point thereof, said first portion including said sensing surface, said second portion operatively coupled to said sensor, said second portion being longer than said first portion.

16. The apparatus of claim 14, further comprising a stop member oriented transversely to said support plate for supporting the stack of envelopes, said feeding apparatus being configured to adjust the pressure exerted by the stack of envelopes onto said stop member in response to the signal received from said sensor.

17. A method of processing a stack of envelopes, comprising:

applying a first force against the stack of envelopes to move them in a travel direction;

engaging a first envelope of the stack with a pivotally movable surface;

extending a leading portion of the first envelope into a region downstream of the movable surface in the travel direction while maintaining a remainder of the first envelope upstream of the movable surface, the leading portion extending transversely to the remainder of the first envelope;

pivotally moving the movable surface in response to the first force; and applying a second force against the stack of envelopes different from the first force.

18. The method of claim 17, wherein applying a second force includes applying a second force lower than the first force.

19. The method of claim 17, further comprising:

applying the second force against the stack of envelopes in response to pivotal movement of the movable surface.

20. The method of claim 17, further comprising:

moving the stack of envelopes in a generally upright orientation.

21. A method of feeding single envelopes from a stack of envelopes moving in a travel direction, comprising:

biasing the stack toward an envelope feed position;

extending a leading portion of a lead envelope of the stack so that the leading portion is oriented transversely to a remainder of the lead envelope;

sensing pressure on the lead envelope at the feed position resulting from the biasing;

removing the lead envelope from the stack by engaging the leading portion thereof; and controlling the biasing in response to the sensing.

22. The apparatus of claim 1, wherein said pressure sensing lever is positioned relative to said support plate to permit a flap of the first envelope of the stack to extend into a region downstream of said sensing surface in the travel direction.

23. The method of claim 17, wherein extending the leading portion into a region downstream of the movable surface includes extending a flap of the first envelope into a region downstream of the movable surface in the travel direction, the method further comprising:

removing the first envelope from the stack by engaging the flap of the first envelope.

24. The method of claim 23, wherein removing the first envelope from the stack includes moving the first envelope in the travel direction across the plane of the movable surface.

25. The method of claim 21, wherein removing the lead envelope from the stack includes moving the lead envelope in the travel direction across a plane of a surface sensing the pressure.

* * * * *